US005417432A

United States Patent [19]

Dwyer

[11] Patent Number: 5,417,432

[45] Date of Patent: May 23, 1995

[54] ALPHABET PLAYING CARD DECK

[76] Inventor: Priscilla J. Dwyer, 15 Longfellow Rd., Reading, Mass. 01867

[21] Appl. No.: 217,456

[22] Filed: Mar. 24, 1994

[51] Int. Cl.[6] ..... A63F 1/00

[52] U.S. Cl. ..... 273/299; D21/46; 434/172

[58] Field of Search ..... 273/299, 272; D21/46; 434/171, 172

[56] References Cited

U.S. PATENT DOCUMENTS

| | | | |
|---|---|---|---|
| D. 56,985 | 1/1921 | Moore | D21/46 |
| 563,619 | 7/1896 | Rosenberger | 273/299 |
| 622,240 | 4/1899 | Latham | 273/299 |
| 742,498 | 10/1903 | Roy | 273/299 |
| 912,547 | 2/1909 | Edwards | 273/299 |
| 977,117 | 11/1910 | McPherson | 273/299 |
| 1,012,574 | 12/1911 | Adams | 273/299 |
| 1,076,307 | 10/1913 | Nicholson | 273/299 |
| 1,107,417 | 8/1914 | Ford | 273/299 |
| 1,188,204 | 6/1916 | Pitt | 273/299 |
| 1,191,419 | 7/1016 | Harrison | 273/299 |
| 1,312,278 | 8/1919 | Shinn | 273/299 |
| 1,332,249 | 3/1920 | Feero | 273/299 |
| 1,377,327 | 5/1921 | Ebert | 273/299 |
| 1,485,146 | 2/1924 | Mundell | 273/299 |
| 1,540,085 | 6/1925 | Partridge | 273/299 |
| 1,542,819 | 6/1925 | Bloom | 273/299 |
| 1,557,824 | 10/1925 | Fritz | 273/299 |
| 2,042,930 | 6/1936 | Emmerich | 273/299 |
| 2,265,334 | 12/1941 | Armbruster | 273/299 |
| 2,783,998 | 3/1957 | Collins | 273/299 |
| 3,654,712 | 4/1972 | Bagdasar | 273/299 |
| 4,026,558 | 5/1977 | Patin | 273/299 |
| 4,192,513 | 3/1980 | Feeley | 273/294 |
| 4,333,656 | 6/1982 | Sommer | 273/299 |
| 4,369,976 | 1/1983 | Chunn | 273/303 |
| 4,402,513 | 9/1983 | Head | 273/296 |
| 4,428,582 | 1/1984 | Smith | 273/296 |
| 4,773,651 | 9/1988 | Papapavlou | 273/249 |
| 4,775,157 | 10/1988 | Armstrong | 273/299 |
| 4,826,175 | 5/1989 | Quatrino | 273/299 |
| 4,877,255 | 10/1989 | von Braunhut | 273/299 |
| 4,923,199 | 5/1990 | Hahn | 273/299 |
| 5,014,996 | 5/1991 | von Braunhut | 273/299 |
| 5,092,777 | 11/1992 | Crowe | 434/159 |
| 5,161,976 | 11/1992 | Crowe | 434/159 |
| 5,199,714 | 4/1993 | Harper | 273/299 |

FOREIGN PATENT DOCUMENTS

| | | | |
|---|---|---|---|
| 773016 | 12/1967 | Canada | 273/299 |

OTHER PUBLICATIONS

Games Magazine, "Word Rummy", from Gabriel, Mar./Apr. 1981, p. 59.

"Hoyle's Modern Encyclopedia of Card Games," by Walter B. Gibson. Main Street Books, Doubleday, 1974.

*Primary Examiner*—Benjamin H. Layno

[57] ABSTRACT

A deck of 56 standard size playing cards. Each card representing one letter of the alphabet and having a duplicate card within the deck. Therefore, there are 52 playing cards being two of 26 cards each having one letter of the alphabet on its face side, and four cards being wild cards or written game play instruction cards; completing a total of 56 cards per card deck. The distribution of the alphabetic letters in the deck is equal as there are two copies of each letter card per deck. The cards are arranged and combined in matching letter recognition games, an alphabetic letter sequence racing game and simple word-forming games.

8 Claims, 4 Drawing Sheets

ALPHABET PLAYING CARD DECK

BACKGROUND—FIELD OF INVENTION

The invention relates to educational and amusement games, specifically to playing card games displaying the alphabet which are intended for use by young children.

BACKGROUND—DESCRIPTION OF PRIOR ART

There is a long recognized need for advancing the preschool education of children to the point that they have achieved alphabet recognition and even sight recognition of simple words before entering their formal grade school training. Children that have this ability have a distinct advantage in the early grades of school over those who enter school without such ability. Unfortunately, parents with limited incomes are generally precluded from giving their children this head start along their educational path. However, most parents, despite limited incomes, do find ways to buy amusements and other games for their children and most of these purchases do not involve educational values of merit.

Several types of letter card deck games and alphabetic recognition games have been previously proposed; however, the failure of these has been in the inclusion of numbers, points or additional words requiring reading skills and therefore these prior patents have created card decks that are too confusing for children. There are also educational games that are so involved with teaching that there is no longer an element of fun: U.S. Pat. No. 3,654,712 is a good example of this. I do not include in this reference those alphabetic card games that are dependent upon boards, dice, spinners, and other similar devices necessary for game play.

I refer to the following card deck games to show how they suffer from a number of disadvantages:

(A)

U.S. Pat. No. 5,199,714; Harper: Apr. 6, 1993

U.S. Pat. No. 4,877,255; Hahn: May 8, 1990

The most recent and closest representation can be found in this prior art which has the disadvantage of including more than two of some letter cards and void of duplicates for other letters, prohibiting a child to play a simple alphabetic matching game.

This disadvantage or similar disadvantage involving the distribution of letter cards to prohibit simple matching requiring duplicate cards for young children also applies to:

U.S. Pat. Nos. 1,312,278, 1,188,204, 742,498, 912,547, 1,012,574, 1,107,417, 4,923,199, 4,826,175, 0,912,547 and 4,428,582. U.S. Pat. No. 5,199,714 also adds confusion with smaller letters shown in the corners not being inverted to allow for random pick-up and proper display of each corner letter at all times.

(B)

U.S. Pat. No. 4,923,199; von Braunhut: May 14, 1991

U.S. Pat. No. 4,826,175; Quatrino: May 2, 1989

U.S. Pat. No. 1,377,327; Ebert: May 10, 1921

U.S. Pat. No. 1,332,249; Feero: March 1920

U.S. Pat. No. 0,977,117; McPherson: Nov. 29, 1910

These patents have the disadvantage due to inclusion of more than one alphabet letter per playing card and numerical point values displayed; therefore, making it difficult to learn the individual letters of the alphabet, the proper sequence of the alphabetic letters or to find simple matches for each letter.

U.S. Pat. No. 4,192,197; John and Ruth Feeley: March 1972

This game has 104 diamond-shaped playing cards, each having the disadvantage of including a three letter sequence and a suit symbol in which melds are made printed on each card.

The following U.S. Patents also have the same disadvantage due to inclusion of two or more alphabetic letters per playing card resulting in confusion of young children beginning to learn to recognize individual letters: U.S. Pat. Nos. 5,014,996, 4,877,255, 4,369,976, 4,333,656, 4,192,513, 4,026,558, 2,783,998, 2,265,334, 1,332,249, 0,742,498 and 977,117.

(C)

U.S. Pat. No. 4,333,656; Steven Sommer: May 1982

This game has a 104 card deck of four complete alphabets with the disadvantage of including suit markings and numerical markings included on each playing card face that children find confusing when they are first learning to recognize their letters.

U.S. Pat. No. 1,076,307; C. M. Nicholson: October 1913

This is a 72 card game using letters and has the disadvantage of including numerical values that create confusion for a young child trying to learn to recognize the alphabet letters.

The following U.S. Patents also contain a similar disadvantage in the inclusion of numerical values necessary for game play on their lettered playing cards: U.S. Pat. Nos. 1,188,204, 1,012,574, 4,428,582, 2,042,930, 1,557,824, 563,619, 1,076,307 and 4,333,656.

(D)

U.S. Pat. No. 3,654,712; Florica Bagdasar: April 1972

These letter cards are contained in a kit which becomes a teaching aid for kindergarten and 1st grade children who are learning the alphabet and the various sounds of the letters. The disadvantage is that each card is independent of one another and void of providing identical matches for ease in learning letter recognition as each card provides both upper and lower case letters on cards. These cards are not suitable for amusement or game play application.

U.S. Pat. Nos. 5,161,976/5,092,777 and 5,014,996; Crowe, 1992 have a similar disadvantage as these teaching and alphabet learning methods include additional and confusing indicia and words preventing children mastering their alphabetic letters with simplicity through game play.

The following U.S. Patents also contain the above disadvantage of including additional word cards necessary for game play and requiring prior reading skills: U.S. Pat. Nos. 1,540,085, 622,240 and 1,542,819.

(E)

U.S. Pat. No. 4,402,513; Head: Sep. 6, 1983

This patent has the disadvantage to include a deciphering mechanism in game play game that provides a numerical ordering of letters needed to bread a coded word card.

(F)

U.S. Pat. No. 4,775,157; Annstrong; Oct. 4, 1988

This patent has the disadvantage due to the inclusion of only those letters that spell B-I-N-G-O and therefore is not in conflict with the propose invention. U.S. Pat. Nos. 1,191,419 and 1,107,417 also have a slogan or other word, or do not include every letter of the alphabet or a duplicate set needed for matching in game play.

(G)

U.S. Patent Design No. 56,985; Moore: Jan. 25, 1921

This design patent has the disadvantage of including more than one version of each alphabetic letter on each card and was designed primarily for use in instructing children to recognize these upper mid lower cases of each letter. The design is at a disadvantage due to inclusion of all letters being displayed in a right-side-up manner and being void of proper display if held in an upside-down-manner allowing for random pick-up from a shuffled deck.

After careful commercial evaluation, none of these products have attained visible commercial success with the exception of traditional flash cards that are used as teaching tools and not being in conflict with this invention. Despite these educational devices being available for many years, they are not widely used, or they do not appeal to the mass market due to lack of amusement. The prior art patent inventions that do not scent to have been commercially exploited properly. This lack of success is perhaps due to lack of simple components (as they are too confusing for young children to play easily), or perhaps due to lack of production.

No games known from prior art enable a pre-school player to come to and enjoy playing the card game without a rudimentary knowledge of reading. No games known from prior art combine educational properties with a means of amusement for young children to play on their own. There is a need, therefore, for an educational game providing contest interest to the pre-school child wherein the child can progress in his recognition from alphabet characters to simple words and thence to more complicated words; all while enjoying a card game for the simple pleasures it contains.

The inventor believes the listed prior art patents and known word or letter games taken alone or in combination neither anticipate nor render obvious the present invention. These citations do not constitute an admission that such disclosures are relevant or material to the present claims. Rather, these citations relate only to the general field of the disclosure and are cited as constituting the closest art of which the inventor is aware.

OBJECTS AND ADVANTAGES OF THE INVENTION

It is the intent of the present invention is to provide a novel and improved playing card deck and games that provides amusement and educational value. With little or no adult supervision, a child of preschool age and experience will come to recognize their letters in the course of playing the present invention's games of simple matching pictures. It is also the intent of the present invention that as the child grows in reading skill that they will enjoy more advanced games that challenge their vocabulary and spelling ability by using the stone deck of cards described or with an identical set of playing cards designed with more sophisticated art and detail. In particular, the invention relates to a card game intended to teach pre-school children their alphabet letters as well as utilize their memory recognition skills in matching pictures that correspond to letter shapes.

Accordingly, besides the objects and advantages of the alphabet playing card deck as will be described in more detail, several objects and advantages of the present invention are:

(A) to provide an alphabet playing card deck that includes duplicates of each alphabet letter card for children to match while learning to discriminate between the shapes of letters necessary for recognition of the alphabet letters which is a beginning reading skill;

(B) to provide an alphabet playing card deck which displays only one alphabet letter per card to provide one character per card for young children to learn to recognize;

(C) to provide an alphabet playing card deck that includes lettered cards void of any other numerical markings and value points to allow young children the amusement of finding matched alphabetic card pairs void of confusing numerals that need not be taken into consideration for game play or in learning the letters of the alphabet;

(D) to provide an alphabet playing card deck that has duplicate letter cards for matching that are void of any other indicia, additional words needed for game play, traditional card suit markings, or any other distracting markings that would allow confusion to the young children learning to recognize the letters of the alphabet, but may include corresponding pictures that will entice children to play games that will help them recognize their letters;

(E) to provide an alphabet playing card deck that is void of any code to decipher or other confusing purpose in game play other than matching, sequencing and spelling of words;

(F) to provide an alphabet playing card deck that includes a complete set of alphabet cards and includes two of each alphabet letter to provide game play and learning of the complete alphabet and is void of any slogan or other card needed for game play; and to (G) to provide a an alphabet playing card deck that provides corner letters for ease of recognizing each alphabet letter as it is randomly put and held in hand by each player by providing a smaller version of the letter card in the upper left hand corner and an inverted or "upside-down" copy of the same letter in the lower right hand corner.

The advantage of this invention is the inclusion of duplicate cards for each letter of the alphabet within a playing card deck, replacing all traditional numbers and suits, to allow matching of letter configurations for young children and spelling of words in traditional card playing for older children. The absence of additional letters and numbers provide children with a simple deck of alphabet letter playing cards that does not previously exist. The advantage of having corner letters that always display a proper oriented letter allows for easier game play and display of words being spelled with these letter cards.

There are "flash card" decks and other letter recognizing games on the market today; but none, to the knowledge of the author of this patent application after much research, use exactly two of each letter (in the stone case and corresponding picture) in a card deck. Prior art games require children to know that an upper case (A) and a lower case (a) should match. The proposed invention of alphabet playing cards feature only one letter of the alphabet per card. A complete deck for this invention would be consistent in style, arrangement and design for each alphabet letter and its duplicate card. "Flash cards" are used for reciting and drill of letters and therefore cannot be included under the game or amusement category.

The previous prior art card games failed to provide entertainment to young children because they were too confusing by including points for scoring, more than one letter per playing card, or word cards that required reading skills not yet learned by young children. Other card decks were developed as traditional flash card decks that provide practice in letter recognition, but no entertainment or game play element. The proposed invention includes five games that can be played with the present invention's alphabet playing cards. These five games are simple, fun, novel and have an educational value of merit. The simplicity of making an alphabetic card deck for children into a game has been overlook and solves an unrecognized problem when compared to the prior art patents listed.

There is definite potential for commercial success for this invention. Although there are many playing cards, there are none that tie in the alphabet as clearly and simply as this invention to provide entertainment for children. By omitting the element of suits, numbers, and points found on traditional playing cards, this invention makes a more efficient, entertaining and improved alphabetic card game for children.

This invention utilizes a modification previously not suggested by having a card deck that includes exactly two of each letter card to allow for matching and still allow for spelling of simple words. This invention solves prior in-operability of flash card decks and other alphabet card games that did not allow for matching and recognition of the shapes of the letters for very young children beginning to learn their letters. These playing cards offer an additional advantage by having a picture that is spelled below to facilitate and offer suggestions of spelling for older children and allow for heightened interest for young children.

The present invention of new alphabet playing cards offers a beginning to a solution to a long felt need of finding an entertaining means to interest youngsters in learning to read and spell. By combining unrelated components of existing parts: the alphabet, playing cards, the distribution of each and by formulating new games to play with these alphabet playing cards; I have invented a significantly new and improved card game that was technically non-existent or obvious before. This simple, yet novel alphabet card deck also hopes to assist in developing a more literate future work force.

BRIEF DESCRIPTION OF THE DRAWINGS

In accordance with the present invention, reference should be made to the following detailed drawings for a better understanding of the amusement and educational card games of the invention presented in this document. The duplicate sets of 26 cards look exactly alike in detail and vary only in color of border design or other similar measure for ease in separating the two complete letter sets of the alphabet.

DESCRIPTION—FIGS. 1, 5, 6

The proposed invention comprises a deck of 56 standard poker sized playing cards made of coated card stock or similar materials or appropriate materials to allow game play. The standard 56 playing cards per deck typically includes thirteen cards of four suits totaling 52 playing cards, with an additional two "jokers" and two informational cards. The proposed deck has 52 cards being two duplicate sets of alphabetic playing cards, and the additional four cards to total 56 cards being "wild or joker" cards or informational cards.

The completed card deck would be packaged in a cardboard tuck case, a plastic card deck holder, wrapped in clear plastic or other suitable packaging necessary, for marketing.

Figure 1:
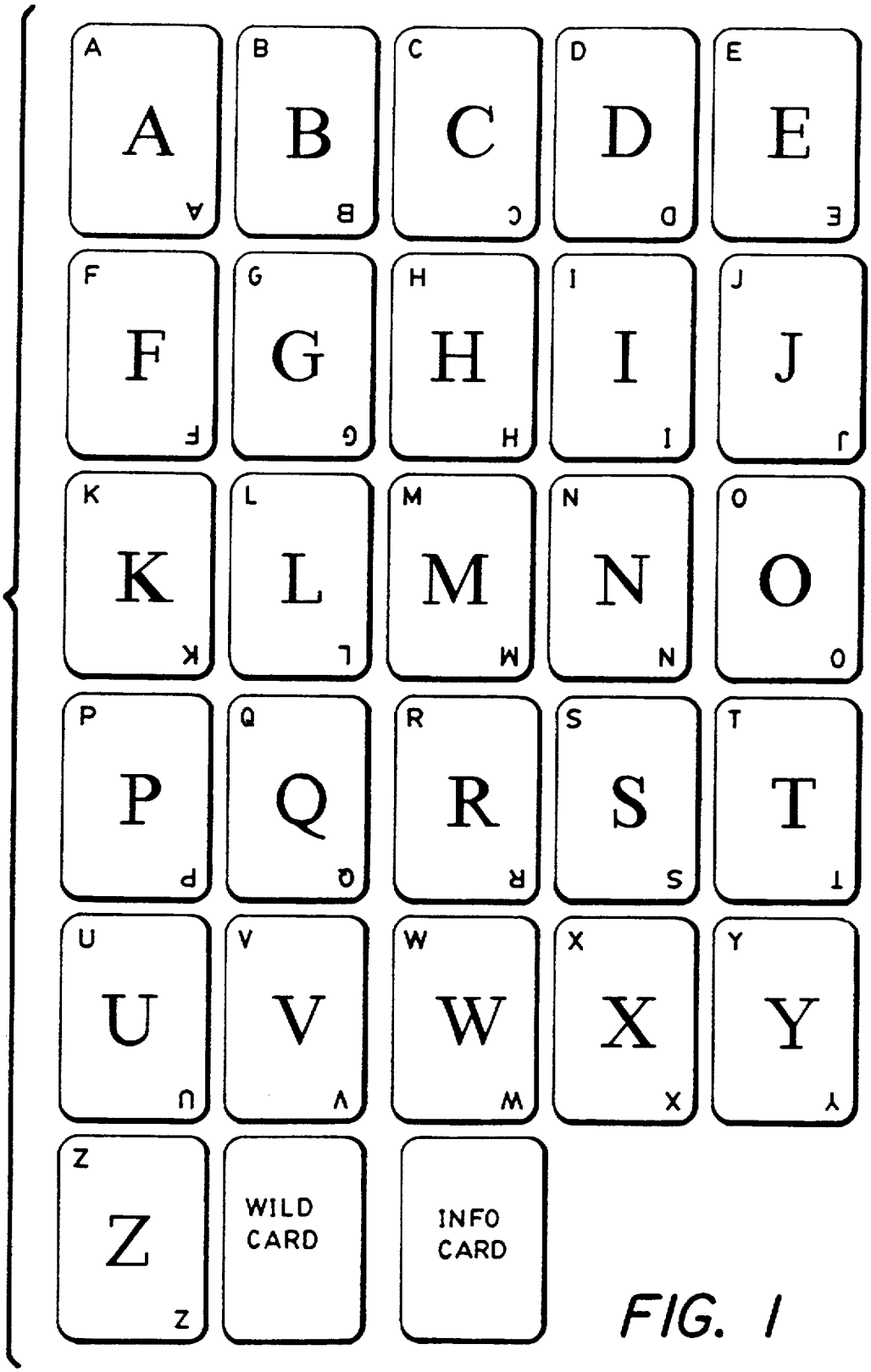
FIG. 1 is a view of the playing faces of each of the cards in the card deck illustrated in a face up position. There are exactly two of each of these cards in a deck. Each deck may also include wild cards or instructional cards that include pictures or text. The backs of each and all of these cards are identical and are decorative and have no other purpose in playing.

Each letter card as depicted in FIG. 1, may also include additional representation of the letter in smaller corner versions to appear in the upper right and lower left hand corners for ease of left handed players. These additional letters would compliment the letter representation as shown in FIG. 1 in the upper left and lower right hand corners. The center letter illustration may be visible as shown in FIG, 1 or be void within the playing card deck of alphabet letters depending upon illustration chosen.

Figure 5A:
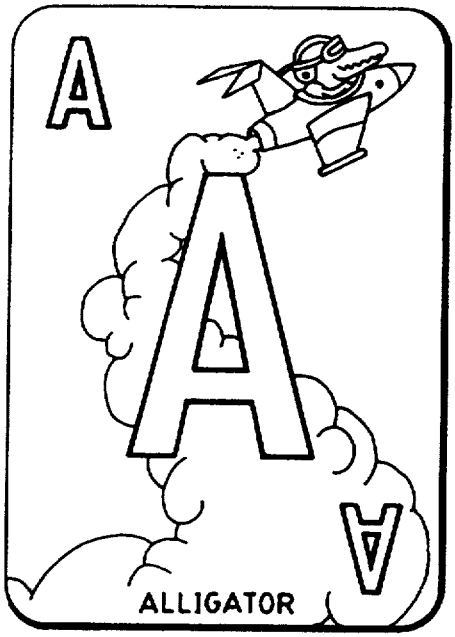
FIGS. 5A–C are views of how three playing cards may be designed with illustration added.
Figure 5B:
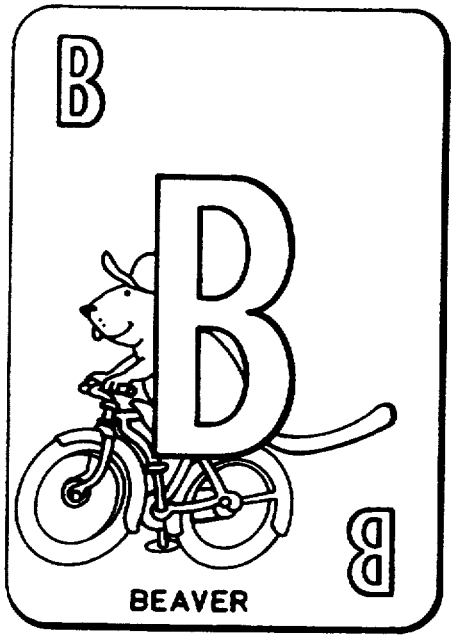
Figure 5C:
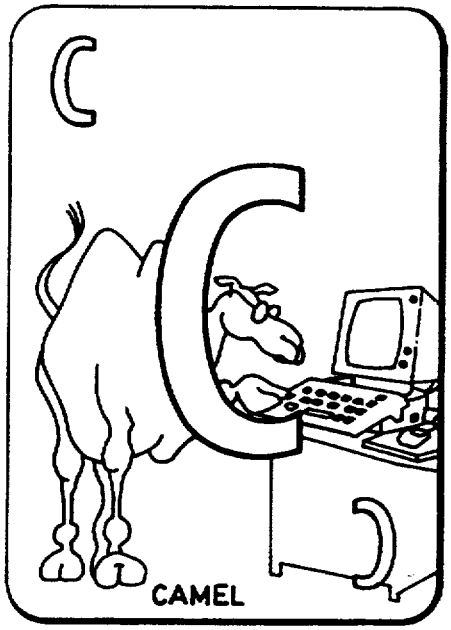

The card decks would be as represented in FIG. 1 or be similar but not be limited to the style of letter or type style shown, nor limited in pictorial design as shown in FIG. 5 but be open to any design, photograph, licensed character or other artwork or lack of design to heighten interest in the commercialization of the proposed invention. As FIGS. 5A–C (previously approved as FIG. 5) shows, the design on each card preferably depicts a subject, the spelling of which starts with the same alphabetic letter appearing on the face of that letter card.

OPERATION—FIGS. 2, 3, 4

Figure 2:
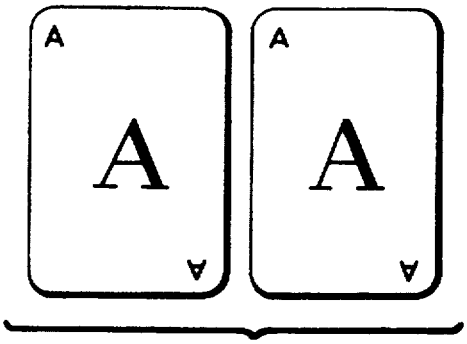
FIG. 2 is a view a matched pair of letter cards that a player would place on the table when found.
Figure 3:
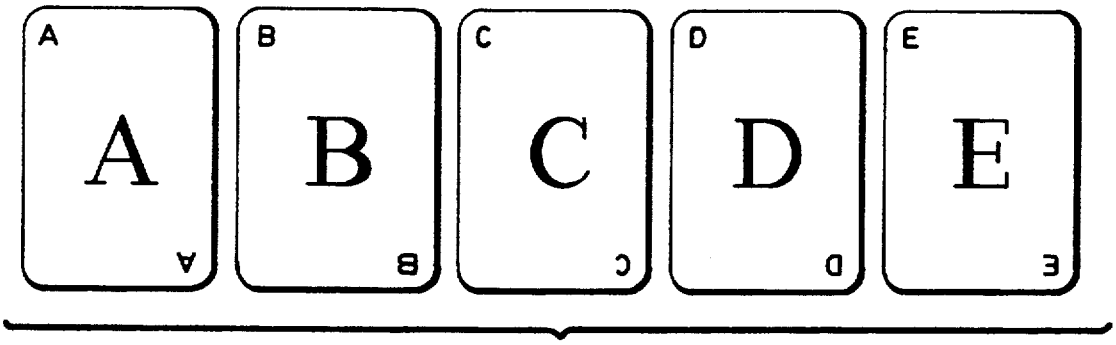
FIG. 3 is a view of the first five cards that would be placed down in the race to complete the alphabet in correct sequential order in playing the game of ABC; 123.
Figure 4:
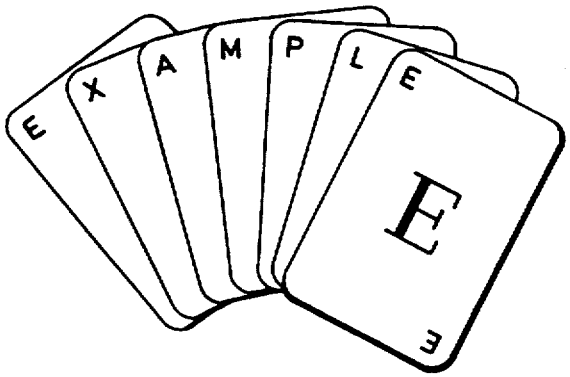
FIG. 4 is a view of a winning hand played in Word Wizard.

The following explanation of how the proposed invention of alphabetic playing cards may be utilized is represented by the drawings shown in FIG. 2, FIG. 3, and FIG. 4. Two additional games are also described below but are not depicted in any drawings. The proposed alphabet card deck is; however, not limited to being utilized in only these mentioned card games, but has the flexibility to be used in a number of games, substituting letters for numbers in many of the games explained in detail in "Hoyle's Modern Encyclopedia of Card Games," or being left to the imagination of any card playing child or adult once exposed to this newly invented alphabetic playing card deck.

Figure 6A:
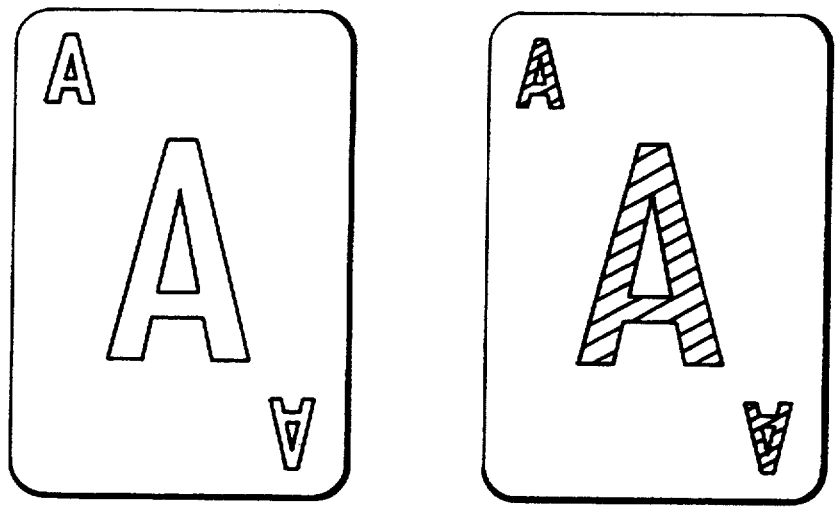
FIGS. 6A–C are views how one set of cards having a first marking thereon in a color different from the color of the marking in the other set.
Figure 6B:
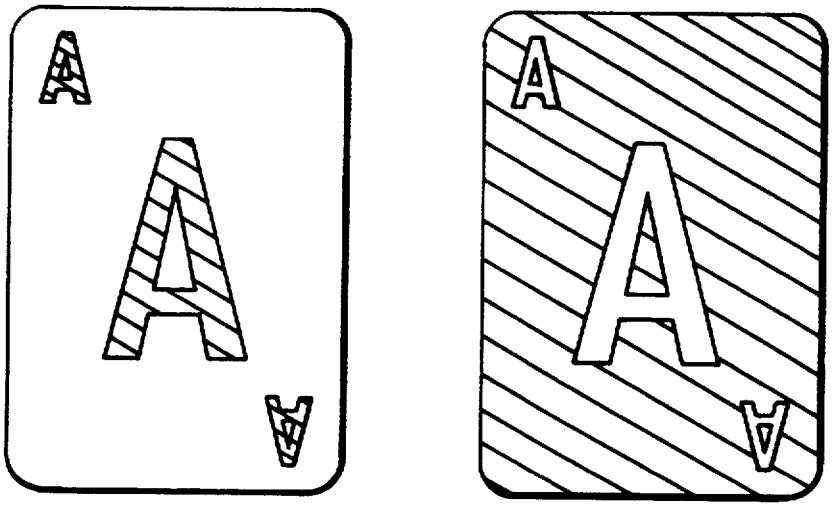
Figure 6C:
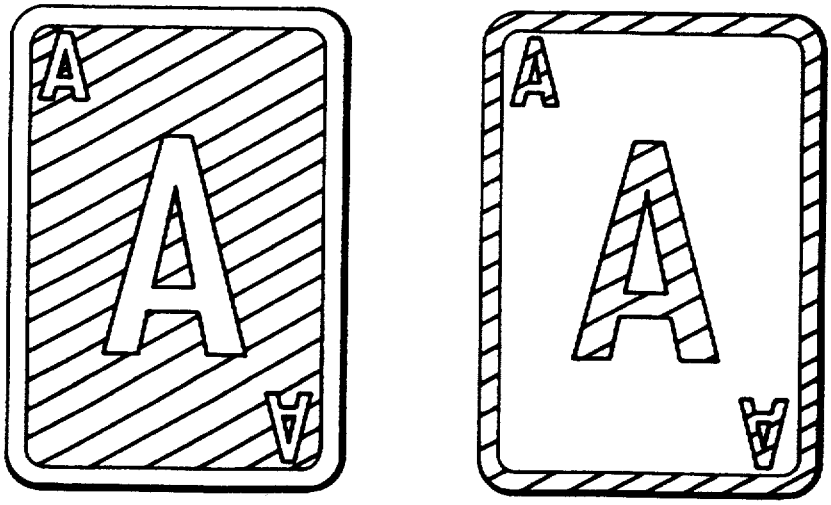

FIG. 2 AlphabetZoop: This game is designed to help with children recognize the letters of the alphabet by matching pictures and letter shapes. Initially, the playing cards are dealt out to the players one at a time until all the cards have been dealt. Each player then looks at their own cards and displays all matching cards face up on the table. The remaining cards are held in each player's hand in confidence. Each player then takes a turn m selecting a hidden card from the player to their right. If a match is found, this is immediately displayed on the table. Play continues until all the cards have been displayed in matching pairs and one player is left holding the Zookeeper or Wild Card. As FIG. 6A–C shows, the other set of cards clearly show that each card in one set has a first marking thereon in a color different from the color of the marking in the other set.

Alphabet Concentration: This game is played by placing all cards face down in a grid like manner. Each child would then take turns turning over two cards at a time trying to find a matched pair. If they do find a matched letter pair, this player gets to take another turn. If a matched pair is not found, then play passes to the next player in turn. The game is over when all cards have been matched. The player with the most matched pairs is the winner or this game can also be played in a cooperative manner.

After children have mastered the above games and are aware that the characters are letters and that the alphabet exists, they may want to play the following game that helps in learning the sequential order and names of the alphabetic letters.

FIG. 3 ABC; 123; A game for two players or two teams of players. Each team is given one half of the letter card deck that equals 26 cards or one each of all the letters of the alphabet. The first team to put the 26 letter cards in the correct sequence from A to Z is the winner and gets the Zookeeper or Wild card. The correct order of the alphabet is available for children to check to see if they have completed the sequence properly.

School of Fish: This is another game that is good for young children in that players ask each other for a particular alphabet letter card (by letter name of picture) that they already hold in their hand. This game increases children's learning capabilities in letter recognition. Players are dealt a hand of seven cards and the object of the game is to match all the cards in hand in pairs. After placing all matched letter pairs found in hand, players take turns requesting the cards that will create matched pairs of their cards left in hand. If the player asked does not have this card, then he responds "Go Fish" and the player takes a new card off the pile of remaining cards not dealt. If the player finds a match either by requesting it of another player or from a draw off the pile, then his turn continues. If a match is not found, then play continues with the next player in turn requesting a match. The game is over when one player has matched all cards in their hand and has displayed them on the table.

Once children have mastered the alphabet and have begun spelling words and reading; the following games will be of more interest.

FIG. 4 Word Wizard: Each player is dealt seven cards. The rest of the cards are placed face down in a single pack. The top card of the pack is turned over face-up to start a discard pile. The first player to the dealer's left looks at his cards and then picks a new card off the pack or the face-up card from the discard pile if he prefers. He adds this new card to his hand that he arranges to spell words using all his cards. Whether he decides to spell a word at this time or not, he discards a card face up to the discard pile. The next player chooses from the pack or the discard pile in selecting his new card and discards a card as well at the end of his turn. The object of the game is to use up all cards in hand by either spelling a word or adding it to another player's word to spell a new word. (Example: Player 1 has put down HAND, Player 2 may put down an L to change the word to LAND, and Player 3 may put down a CY to change it again to CANDY.) The first player to use up all his cards wins.

Another version of Word Wizard, would involve choosing between picking up the top card of the pack or the entire discard pile, whether it be 1 or 12 cards. Each card used in a word counts as a point for that player. (The player who spelled CANDY with a CY would receive 5 points.) Cards left in hand are given to the person who plays out all their cards first. Each newly given card is valued at one point apiece. Play continues until one player earns one hundred points. For older children, two packs of alphabet cards can be used. This will allow for words needing more than two of any letter to be spelt. Ten cards should be past out to each player. Other game versions may include but are not limited to using acronyms, initials, abbreviations, proper names, or holidays to create a more specialized Word Wizard Card Game.

There are also many versions of numerical card games that can be played with the alphabetic card deck proposed by substituting sequenced letters and words for traditional suits and runs as dictated by *Hoyles' Encyclopedia of Card Games.*

SUMMARY, RAMIFICATIONS, AND SCOPE

The invention, in its broadest sense, includes a game played with cards or other similar elements, two of each bearing the same letter of the alphabet on its surface. The complete card deck will include two of each alphabet letter to complete a common 52 playing card deck, with additional wild and instruction cards; totaling no more than 56 cards per deck. The alphabetic playing cards will be designed to display the letter right-side-up in the upper left hand corner, regardless of the vertical manner in which the card is held.

The deck is to be of standard sized poker playing cards with or without one large letter of the alphabet in the middle; but always with smaller reproductions of the same letter of the alphabet in the upper left and bottom right hand corners. Each letter of the alphabet will be represented in the same manner twice per card deck. There will different colored borders or other differentiating feature for each of the two sets of alphabetic cards that complete a card deck to allow for young children to separate the card deck into two complete alphabetic sequences.

No numbers will accompany the deck to confuse the simple task of matching letters for small children. Each card will also contain a related "picture" not to be limited to illustrations, licensed characters, replicas of fine art, licensed logos or trademarks, and/or photographs. The purpose of the "picture" is to provide interest and amusement in playing the game. Young children, therefore, can match the pictures as they get accustomed to matching the letters of the alphabet. Pictures may or may not repeat the alphabet letter of the card depicted in the corners.

The proposed invention of an alphabetic letter card deck is novel when compared to all other card deck previously stated as it provides a new way for children to learn their letters while playing a game. Previously, children have been learning letter recognition skills through rote practice and "flash cards" in an educational manner. Children like to play games and this is a means for allowing children to learn their letters through enjoyment of a card game. The invention presented here is unobvious as it is a combination of alphabet flash cards and new and existing children's card games. This synergistic effect is true to definition in that the combined parts create a wholly new invention that provides for a substantial and significantly different use its previously know parts.

This invention provides children with a game that grow as their knowledge grows. At first very young children will be only interested in matching the shapes of the letters, this will soon advance to knowing which letter appears in the proper sequence in the alphabet, and finally to the point where older children will be spelling simple words. For these reasons, this new invention is easily marketed and needed by today's children and parents.

With the state of illiteracy that our country is in today, it seems that here is a new and inexpensive means to help children learn to read and enjoy learning. The cards are represented in one form, but however should not be limited to this design as there are many alternative physical forms that this card deck can take to attract the children of today.

In another varied form, targeting older children and adults: the individual pictures chosen to illustrate each letter of the alphabet can be designed to be more sophisticated in style. Illustrations would be chosen to interest this particular group to continue playing word games with the stone distribution of letter; two of each letter per deck, as planned for this original pre-school alphabetic card deck.

All the above mentioned games combine chance and skill as this alphabet card deck has been developed to provide amusement, teach the letter shapes of the alphabet, encourage reading and spelling and to show that learning is fun.

This specified alphabetic card deck invention grows with children as they expand their knowledge by offering more advanced games that can be played with the stone deck of alphabet playing cards. These games require spelling and will help older children improve their language skills while having fun. Although only a few methods of game play are mentioned in this application, it is easy for older children to use this alphabetic card deck to play most conventional card games. With this alphabetic card deck, words are substituted for suits, runs, and straits as dictated by Hoyle's Modem Encyclopedia of Card Games. The results being novel and interesting new games that are easy to play.

Although the description above contains many specifications, these should not be construed as limiting the scope of the invention but as merely providing illustrations of some of the presently preferred embodiments of this invention. For example, foreign language cards may also be created by just changing pictures illustrated to correspond with each letter of the particular language's alphabet. Here again, each letter will be duplicated per deck to allow players the same games and by the same rules.

Thus the scope of the invention should be determined by the appended claims and their legal equivalents, rather than by the examples given.

What I claim as new and desired to be secured by Letters Patent of the United States is:

1. A playing card deck having a selected number (n) of letter cards comprising two sets of playing cards, each set having half said selected number (n/2) letter cards, each card having a playing face bearing indicia representing a letter of the alphabet wherein each set has playing cards representing all letters of the alphabet, each card bearing smaller versions of that same letter in two diagonal opposing corners of the playing thee, one smaller version of said letter being inverted, each card also bearing a design representing the letter which it bears, each card in one set having a first marking thereon in a color different from the color of the marking on the other set, said deck further being free of all numerical references on the playing face and further comprising at least one wild card having indicia distinguishable from the letter cards.

2. The card deck of claim 4 in which one letter only is represented on each playing card face, and in which the completed card deck has two matching or duplicate cards, one in each set thereof, for each alphabetic letter.

3. The card deck of claim 1 in which the two sets of playing cards distinguish from each other by a different color of said marking, which may be found in a border design, in the letter or in other similar measure for ease in separating the two complete letter sets of the alphabet.

4. The card deck of claim 1 wherein said designs on each letter card represent a subject, the spelling of which starts with the same alphabet letter appearing on the face of that letter card.

5. The card deck of claim 4 further comprising at least one additional informational card bearing game play instructions or information relating to the subject designs of claim 4.

6. In said design of claim 4 is selected frown abstracts that may include any and all other illustrations, photographs, replicas of fine art, licensed characters, logos, trademarks or other artwork when the spelling of said design begins with the same alphabetic letter appearing on that letter card.

7. The card deck of claim 4 wherein said number (n) of letter cards is 52 and each said set of letter cards has 26 cards, and the letters represent the letters of the English language.

8. The apparatus of claim 7 further characterized in that the playing card deck has up to four additional informational playing cards, be they "wild" or non-playing, to constitute a playing card deck of at least 54 cards, and not more than 56 cards.

* * * * *